United States Patent [19]

Pronzinski

[11] Patent Number: 4,712,263

[45] Date of Patent: Dec. 15, 1987

[54] NEONATAL BLANKET

[76] Inventor: Catherine Pronzinski, 1390 Cadence Way, Santa Rosa, Calif. 95401

[21] Appl. No.: 946,305

[22] Filed: Dec. 24, 1986

[51] Int. Cl.[4] ..... A61G 11/00; A47C 21/00; A47D 15/00

[52] U.S. Cl. ..... 5/508; 128/132 R; 150/52 R; 220/4 B; 220/82 R

[58] Field of Search ..... 5/100, 508, 424, 414, 5/482; 312/284; 150/52 R; 220/4 B, 82 R; 128/1 B, 132 R

[56] References Cited

U.S. PATENT DOCUMENTS

| | | | |
|---|---|---|---|
| 1,254,406 | 1/1918 | Karr | 312/284 |
| 2,820,683 | 1/1958 | Monaco | 312/284 |
| 2,853,997 | 9/1958 | Scherck | 128/1 B |
| 2,998,896 | 7/1961 | Miller | 220/4 |
| 3,130,288 | 4/1964 | Monaco et al. | 312/284 |
| 3,344,442 | 10/1967 | Andrews et al. | 5/100 |
| 4,375,862 | 3/1983 | Kurinsky et al. | 312/284 |

FOREIGN PATENT DOCUMENTS

| | | | |
|---|---|---|---|
| D14501V | 7/1956 | Fed. Rep. of Germany | 128/1 B |

*Primary Examiner*—Alexander Grosz
*Attorney, Agent, or Firm*—Larry D. Johnson

[57] ABSTRACT

The neonatal blanket of this invention provides a generally elongated hemispheroidal, self-supporting thermal barrier for use with neonatal infants on open radiant warmer beds or convection-warmed infant incubators. The blanket can be formed from a single sheet of flexible clear plastic vinyl of similar material, shaped to provide a concave central cavity of a size to generally accomodate a neonatal infant, and having a relatively narrow, flat edge portion that extends around the blanket's perimeter. In use, the blanket is placed completely over the infant, so that its inner surface is close to but does not contact the infant's skin, and the flat edge portion both helps to support the blanket and provide an effective and efficient seal with the bedding material below. Thus, the blanket captures a volume of dead air space around the infant, which helps to reduce convective air currents within the infant's thermal microenvironment.

7 Claims, 5 Drawing Figures

NEONATAL BLANKET

BACKGROUND OF THE INVENTION

1. Field of the Invention

This invention relates generally to infant incubators and radiant warmers, and more specifically to an improved thermal barrier device for premature infants.

2. Description of the Prior Art

Maintenance of body temperature in premature infants is of critical importance to their health and survivability. Accordingly, specialized devices have been developed to help provide this thermal maintenance, such as open radiant warmer beds and convection-warmed infant incubators. Such devices offer an efficient means for re-warming premature infants who have been cold stressed, while allowing access to the infant for emergency resuscitation, diagnostic, and therapeutic procedures, and further enabling uninterrupted heat delivery for maintenance of body temperature during routine nursing and medical care.

However, there are some disadvantages in using these radiant warmer beds (and, to a lesser degree, infant incubators) for such purposes. For example, some premature infants cared for in these devices have exhibited large increases in insensible water loss, which significantly complicates the management of fluid and electrolyte therapy in the infant. Furthermore, some infants nursed under radiant warmers exhibit increased oxygen consumption, which suggests that they may be subject to significant thermal disturbances, and thus indicates a failure to achieve the desired thermoneutral state.

Some neonatal care practitioners have addressed these problems by covering the infants with a thin blanket of plastic wrap, bubble wrap, or other plastic film material. Such material acts as a shield to reduce insensible water loss to the infant, reduce convective air currents within the infant's thermal microenvironment, and reduce the radiant or convective heat input required to maintain the infant's body temperature. In addition, it has been determined that infant oxygen consumption is reduced as a result of the changes produced by such a blanket in the infant's thermal environment. See, for example, "Reduction of Oxygen Consumption, Insensible Water Loss, and Radiant Heat Demand with Use of a Plastic Blanket for Low-Birth-Weight Infants Under Radiant Warmers", by Stephen Baumgart, M.D., in *Pediatrics,* Volume 74 No. 6 (December 1984).

Unfortunately, use of these plastic film blankets has several practical disadvantages. For example, preparation and placement of these blankets is inefficient and time-consuming to the practitioner, generally requiring measuring, cutting, and taping of the plastic. Furthermore, even when in place, the plastic film material does not form an effective seal around the infant. In addition, these blankets are not easily cleaned, thereby requiring frequent replacement of the blankets to avoid contamination and/or infection to the infant. Also, some infants seem to find contact with the plastic to be irritating, and thus they may become aggravated by its presence. Other, simply active infants tend to push the blanket off of themselves, thereby negating the beneficial effects of the blanket in the first place. Still further, such blankets tend to be so thin and frail that they do nothing to provide an effect of sensory deprivation (e.g., quiet), something which is believed to be desirable in the neonatal care environment. Finally, while such blankets are generally optically transparent, they tend to distort a clear view of the infant.

SUMMARY OF THE INVENTION

The neonatal blanket of this invention provides a generally elongated hemispheroidal, self-supporting thermal barrier for use with neonatal infants on open radiant warmer beds or convection-warmed infant incubators. The blanket can be formed from a single sheet of flexible clear plastic vinyl or similar material, shaped to provide a concave central cavity of a size to generally accomodate a neonatal infant, and having a relatively narrow, flat edge portion that extends around the blanket's perimeter. In use, the blanket is placed completely over the infant, so that its inner surface is close to but does not contact the infant's skin, and the flat edge portion both helps to support the blanket and provide an effective and efficient seal with the bedding material below. Thus, the blanket captures a volume of dead air space around the infant, which helps to reduce convective air currents within the infant's thermal microenvironment.

The neonatal blanket is designed to be self-supporting, that is, it retains its shape even under the warming conditions of infrared lamps or the convective heat of an incubator. Thus, the blanket is easily and quickly placed over the infant, and it stays in position there, since it is not in direct contact with the infant. While the blanket material is inexpensive enough to be considered a disposable item, the inherent rigidity of the plastic is also desirable in that it enables the blanket to be easily cleaned and re-used (if necessary). However, the blanket is also collapsible, and can be readily folded and moved out of the way of the infant when necessary, even within the confines of an incubator. When the blanket is to be put back into place, it can be simply "popped" back into shape and placed over the infant, utilizing the inherent plastic memory of the material to recreate its original shape. Furthermore, the blanket material can be cut or punctured to enable placement of respirator tubes, intravenous lines, and the like, without affecting the thermal seal. The shape of the neonatal blanket is such that several blankets can be placed on top of one another in nesting fashion, which reduces storage requirements and promotes easy shipping and handling.

Depending on the specific material used to construct the neonatal blanket of this invention, it may be necessary to incorporate formed ridges or other structural enhancements to enable the overall hemispheroidal shape to be self-supporting, and not collapse over the infant. Such ridges are easily formed into most plastic materials at the time of forming the overall shape itself.

It has been observed that removal of a blanket, including this improved neonatal blanket, from over an infant can quickly and drastically reduce the temperature around the infant. Accordingly, in one embodiment of this invention, the elongated hemispheroidal shape of the blanket is segmented along a generally vertical plane into two portions, for example, dividing the blanket $\frac{2}{3}$ of the way along its longer diameter. In this way, when the entire blanket is in place, one portion may be removed independently of the other. This allows immediate access to the infant within the blanket, for suctioning, taking vital signs, and the like, while still maintaining a significant part of the thermal covering over the infant. When placed back into position, the two portions should slightly overlap, enabling the natural self-adhering tendency of the plastic material to form a seal along the overlap portion.

The neonatal blanket is preferably made from a clear material, so that it is transparent to the infrared lights that warm the infant, as well as being optically transparent for unobstructed and undistorted viewing of the infant. Even though optically clear, however, the blanket's material reduces sound levels within it's totally enclosed confines, and thus serves to provide an acoustically sensory deprived environment. This is felt to be desirable, especially in the active and sometimes loud environment of an intensive care nursery. In addition, the mere presence of the blanket over the infant tends to remind the attendants and other well-intentioned people that handling of the infants should be kept to a minimum.

Thus, the neonatal blanket of this invention provides an efficient, effective way to help control the microenvironment around a neonatal infant being cared for under a radiant warmer or within an infant incubator, and reduces the infant's insensible water loss and oxygen consumption, while simultaneously reducing radiant or convective heat demand.

DETAILED DESCRIPTION OF A PREFERRED EMBODIMENT

Figure 1:
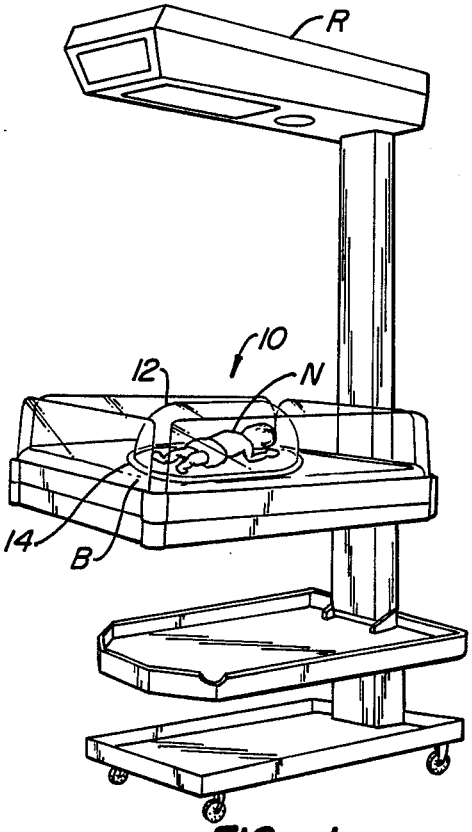
FIG. 1 is a perspective view of a neonatal blanket of this invention in place over an infant in a typical open radiant warmer bed device.

FIG. 1 illustrates a neonatal blanket 10 in use and in place over a neonatal infant N being cared for beneath a typical radiant warmer device R. Neonatal blanket 10 is sized and shaped to cover (without touching) the infant with a thermal barrier to reduce convective air currents around the infant. Blanket 10 may be constructed of 30 guage clear plastic vinyl or similar material, and may be heat-molded or otherwise shaped to create the desired form. Blanket 10 includes elongated hemispherical cover portion 12, and a generally flat perimeter edge 14 portion which contacts the bedding material B.

Figure 2:
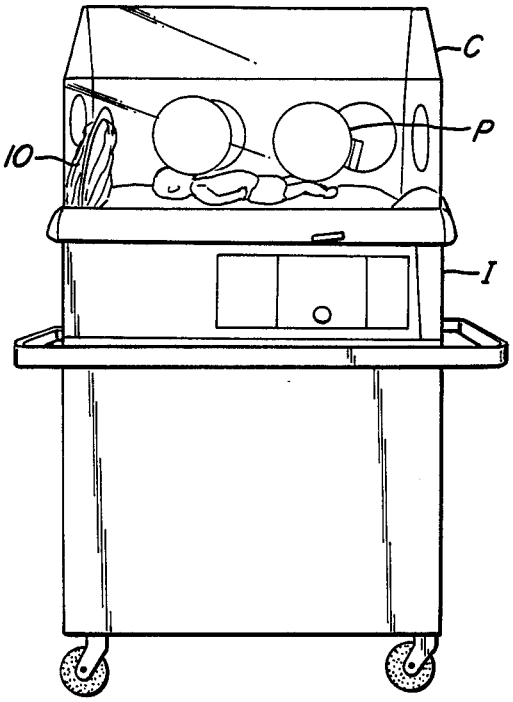
FIG. 2 a side view of the neonatal blanket, shown in its collapsed configuration within a typical convection-warmed infant incubator device.

FIG. 2 shows the neonatal blanket 10 as collapsed and folded into a corner of a typical infant incubator I. Thus, the blanket 10 can be easily removed from an infant, even within the confines of an incubator, and without removing the incubator cover C, simply by reaching through the incubator portholes P and folding the blanket out of the way. The blanket can be reformed simply by flexing the material until it returns to its original shape, and then placed back over the infant.

Figure 3:
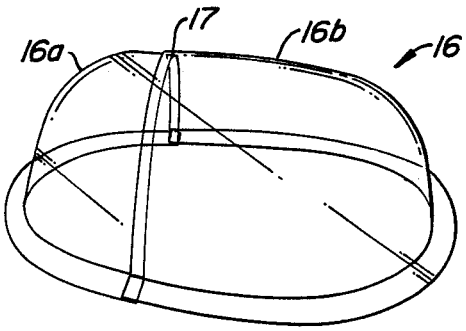
FIG. 3 is a perspective view of a two-piece version of a neonatal blanket of this invention, shown in its assembled configuraton.

FIG. 3 is a view of a two-piece version 16 of the neonatal blanket of this invention. Blanket 16 comprises a first portion **16*a*, and a second portion 16*b* shown slightly overlapped along overlap portion 17. The proportional sizes of portions 16*a* and 16*b* can of course vary, but a division of $\frac{1}{3}$-$\frac{2}{3}$ has been found to be appropriate for many applications. The overlap portion 17** tends to act as a simple seal, due to the inherent self-adhesive nature of the plastic surfaces.

Figure 4:
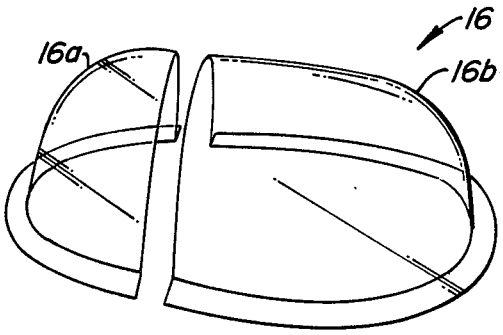
FIG. 4 is a perspective view of the two-piece version of the neonatal blanket in its separated configuration.

FIG. 4 shows the two-piece version 16 as separated into its distinct portions **16*a* and 16*b***. In this way, one portion may be removed from over an infant, without removing the other portion, and thereby preserving at least some of the controlled microenvironment around the infant.

Figure 5:
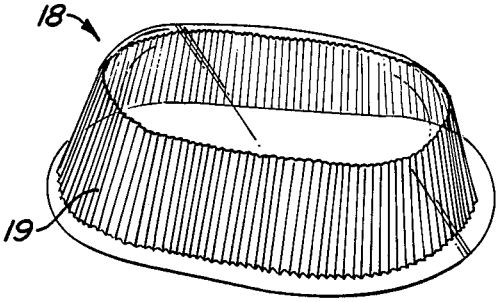
FIG. 5 is a perspective view of a ridged version of a neonatal blanket of this invention.

FIG. 5 illustrates a ridged version 18 of the neonatal blanket of this invention. Structural ridges 19 may be incorporated into the hemispherical cover of the blanket to provide enhanced structural rigidity to the system.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A blanket for a neonatal infant comprising:

a flexible, collapsible cover having a central cavity portion of a size to generally accomodate a neonatal infant, said central cavity having an inside surface; and an edge portion for placement on a bedding surface, so that when said cover is placed over said infant, said edge rests upon said bedding surface, said central cavity inside surface does not contact said infant, and said cover forms a barrier to convective air currents said blanket being segmented into at least two portions, so that one portion can be removed from said bedding surface without the removal of the other.

2. The neonatal blanket of claim 1 wherein said cover is generally elongated hemispherical in shape.

3. The neonatal blanket of claim 1 wherein said edge forms a seal with said bedding surface.

4. The neonatal blanket of claim 1 wherein said cover is of a shape to be nestable within other blankets.

5. The neonatal blanket of claim 1 wherein said cover includes structurally reinforcing ridges.

6. The neonatal blanket of claim 1 wherein said blanket is segmented along a horizontal axis.

7. The neonatal blanket of claim 1 wherein said blanket is made of an optically transparent material.

* * * * *